US008235428B2

(12) United States Patent
Hunt et al.

(10) Patent No.: US 8,235,428 B2
(45) Date of Patent: Aug. 7, 2012

(54) LOCK UNIT HAVING A SLOTTED PAWL

(75) Inventors: Robert Hunt, Davisburg, MI (US); Jim Zhuang, Canton, MI (US); Werner Pohle, Dortmund (DE)

(73) Assignee: Kiekert AG, Heiligenhaus (DE)

( * ) Notice: Subject to any disclaimer, the term of this patent is extended or adjusted under 35 U.S.C. 154(b) by 447 days.

(21) Appl. No.: 12/502,313

(22) Filed: Jul. 14, 2009

(65) Prior Publication Data

US 2011/0012376 A1 Jan. 20, 2011

(51) Int. Cl.
*E05C 3/06* (2006.01)
*E05C 3/16* (2006.01)

(52) U.S. Cl. ..... 292/216; 292/DIG. 62

(58) Field of Classification Search ..... 292/201, 292/216, DIG. 62
See application file for complete search history.

(56) References Cited

U.S. PATENT DOCUMENTS

| | | | | | |
|---|---|---|---|---|---|
| 3,504,511 | A * | 4/1970 | Allen | 70/241 |
| 4,172,768 | A * | 10/1979 | Cerdan | 292/216 |
| 4,334,704 | A * | 6/1982 | Yamada | 292/216 |
| 4,917,420 | A * | 4/1990 | Rogers, Jr. | 292/198 |
| 4,936,611 | A * | 6/1990 | Palvolgyi | 292/28 |
| 5,273,325 | A * | 12/1993 | Zimmermann | 292/216 |
| 6,105,459 | A * | 8/2000 | Troiano | 74/542 |
| 6,485,071 | B2 * | 11/2002 | Schwaiger | 292/216 |
| 6,547,291 | B1 * | 4/2003 | Schwaiger | 292/216 |
| 2008/0012353 | A9 | 1/2008 | Graute et al. | |
| 2010/0052336 | A1 | 3/2010 | Bendel et al. | |
| 2011/0260475 | A1 * | 10/2011 | Spurr et al. | 292/195 |

FOREIGN PATENT DOCUMENTS

| | | | |
|---|---|---|---|
| DE | 102007003948 | A1 | 5/2008 |
| DE | 102008061524 | A1 | 6/2010 |
| EP | 1620615 | B1 | 10/2006 |
| WO | WO 2008061491 | A1 | 5/2008 |

* cited by examiner

*Primary Examiner* — Carlos Lugo
(74) *Attorney, Agent, or Firm* — Leydig, Voit & Mayer, Ltd.

(57) ABSTRACT

A lock unit for a vehicle includes a rotatable catch biased in an opening direction about a catch rotation axis toward an open position of the lock unit in which a first recess of the catch is configured to receive a striker of the vehicle. Additionally, the catch includes a second recess disposed before the first recess in the opening direction. A pawl including a slot rotatable about a fixed pawl pivot axis is biased toward both the catch and the pawl pivot axis. The pawl includes a blocking arm which extends into the second recess of the catch when the lock unit is in a secondary latched position. A blocking lever of a ratchet abuts the blocking arm of the pawl against the catch in a primary latched position of the lock unit preventing rotation of the pawl away from the catch. When the lock unit is forced from the secondary latched position to the primary latched position, the pawl moves in a longitudinal direction of the slot avoiding the rotational blocking action of the ratchet.

20 Claims, 7 Drawing Sheets

LOCK UNIT HAVING A SLOTTED PAWL

FIELD OF THE INVENTION

The present invention relates generally to door latches, and more specifically to a lock unit for the door of a vehicle utilizing a pawl having a slot mounted on a fixed pawl pivot axis.

BACKGROUND OF THE INVENTION

Lock units customarily used for side-doors of motor vehicles utilize a latching mechanism, known as a catch, which receives a catch-bolt, or striker, disposed on a pillar of the vehicle doorframe. The catch is biased to an open position wherein a slot of the latch housing is aligned with a recess of the catch. As the door is shut, the striker enters the recess through the slot and rotates the catch to a closed position in which the striker is retained in the recess by a pawl which prevents the catch from rotating toward the open position. Typically the pawl is heavily biased towards the catch with the interface of the two comprised of a further negative biased angle to resist high acceleration forces. The latch housing is typically made of plastic and may be closed sealingly all-around by a cover outside the region of the slot. Such lock units typically include at least one release lever (e.g., an inside or outside door handle) and a displaceable locking mechanism (e.g., a lock cylinder at or in the outside door handle or a slide button disposed inside the window pane area of the door). In such a case, with the locking mechanism unlocked, the motion of the inside or outside door handle is interconnected through the mechanism and the motion separates the connection of the pawl and the catch by overcoming the pawl bias forces, thereby allowing the spring-loaded catch to move to the open position.

As required by law, lock units for doors, hatches and tailgates of motor vehicles must be provided with a secondary latched position in addition to the primary latched position. This secondary latched position falls between the primary latched position and the open position such that if the catch fails to reach the primary latched position, the door will be retained shut in the secondary latched position rather than moving all the way to the open position, which would obviously be dangerous to an occupant of a moving vehicle. In addition to preventing the vehicle door from opening during travel, the secondary latched position is also perceptible when a user does not close the vehicle door with sufficient force. By law, the secondary latched position leaves the door visibly ajar when the vehicle door is closed with too little force to be noticed that it is not securely latched. By applying additional force (e.g., leaning against the vehicle door), the latching mechanism can be forced into the primary latched position and the door completely shut.

When released from the primary latched position by actuating the release lever, the pawl abruptly breaks away from the corresponding locking surface of the catch and the spring-loaded catch moves at a high velocity to the open position. The abrupt movement of the locking surfaces against one another results in a significant opening clack followed immediately by a second significant clack caused by the catch making impact with a limit stop as it reaches the open position. Owing to the high forces biasing the locking surfaces of the pawl and catch against one another (and also biasing the catch toward the limit stop), the noises caused by opening the vehicle door are quite loud. Additionally, the high impacts on the pawl and catch can cause damage to the lock unit and severely limit its useful life, especially since most of the impact occurs along the locking surfaces.

German Patent Application No. DE 10 2007 003 948 A1 describes a multi-pawl latching mechanism which reduces both the latching noises during opening and the forces required to actuate the latching mechanism. The locking surfaces of the catch and a first pawl are correspondingly chamfered and canted to achieve a smooth and gradual sliding when the locking surfaces are released from one another. Because the locking surfaces were designed to reduce the resultant shear forces caused by the locking surfaces pressing against one another while the catch is released, the forces required to actuate the locking mechanism are also correspondingly reduced. Further, due to the reduction in forces acting on the latching mechanism, the noise produced during opening is significantly reduced.

However, because the locking surfaces are designed to slide relatively easily with respect to one another, the latching mechanism is not self-latching (i.e., the locking surfaces do not hold the catch in place on their own) and requires a pawl blocking lever to hold the first pawl against the catch in the primary latched position. Additionally, to achieve a secondary latched position, a second pawl is also required. To prevent the pawl blocking lever from engaging in the secondary latched position during closing, the second pawl is disposed in a separate plane from the catch, the first pawl and the blocking lever. The secondary latched position is achieved if the primary latched position fails to engage (e.g., first pawl slides off the catch) by a bolt extending from the catch to the plane of the second pawl which abuts a blocking arm of the second pawl in the opening path of the catch. Providing the second pawl on a different plane and the introduction of the bolt into the catch can be costly from a manufacturing standpoint, however. Thus, while the multi-pawl design effectively reduces opening noise and latch actuation forces, it requires multiple different components at multiple planes of the latching mechanism, thereby making the device relatively complex and expensive to manufacture.

SUMMARY OF THE INVENTION

In order to reduce size and manufacturing costs, the primary and secondary latched positions of a lock unit should reside on the same plane as the catch. Further, providing a single blocking arm of a single pawl to achieve the primary and secondary latched positions helps to further simplify the design and ensure consistent operation. However, the lock unit should still utilize a smooth release of locking surfaces to minimize noise and actuation forces. In addition, the design should take into account manufacturing tolerances such that minor dimensional variations will not adversely effect the performance of the lock unit.

In an embodiment, the present invention provides a lock unit having a pawl disposed intermediate a catch and a blocking lever. The catch is rotatable and biased in an opening direction about a catch rotation axis toward an open position of the lock unit in which a first recess of the catch is configured to receive a striker of the vehicle. Additionally, the catch includes a second recess disposed before the first recess in the opening direction. The pawl includes a slot rotatable about a fixed pawl pivot axis and is biased toward both the catch and the pawl pivot axis. Further, the pawl includes a blocking arm which extends into the second recess of the catch when the lock unit is in a secondary latched position. The blocking lever abuts the blocking arm of the pawl against the catch in a primary latched position of the lock unit. When the lock unit is forced from the secondary latched position to the primary latched position, opposite the opening direction of the catch, the pawl moves in a longitudinal direction of the slot and avoids displacement of the blocking lever.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
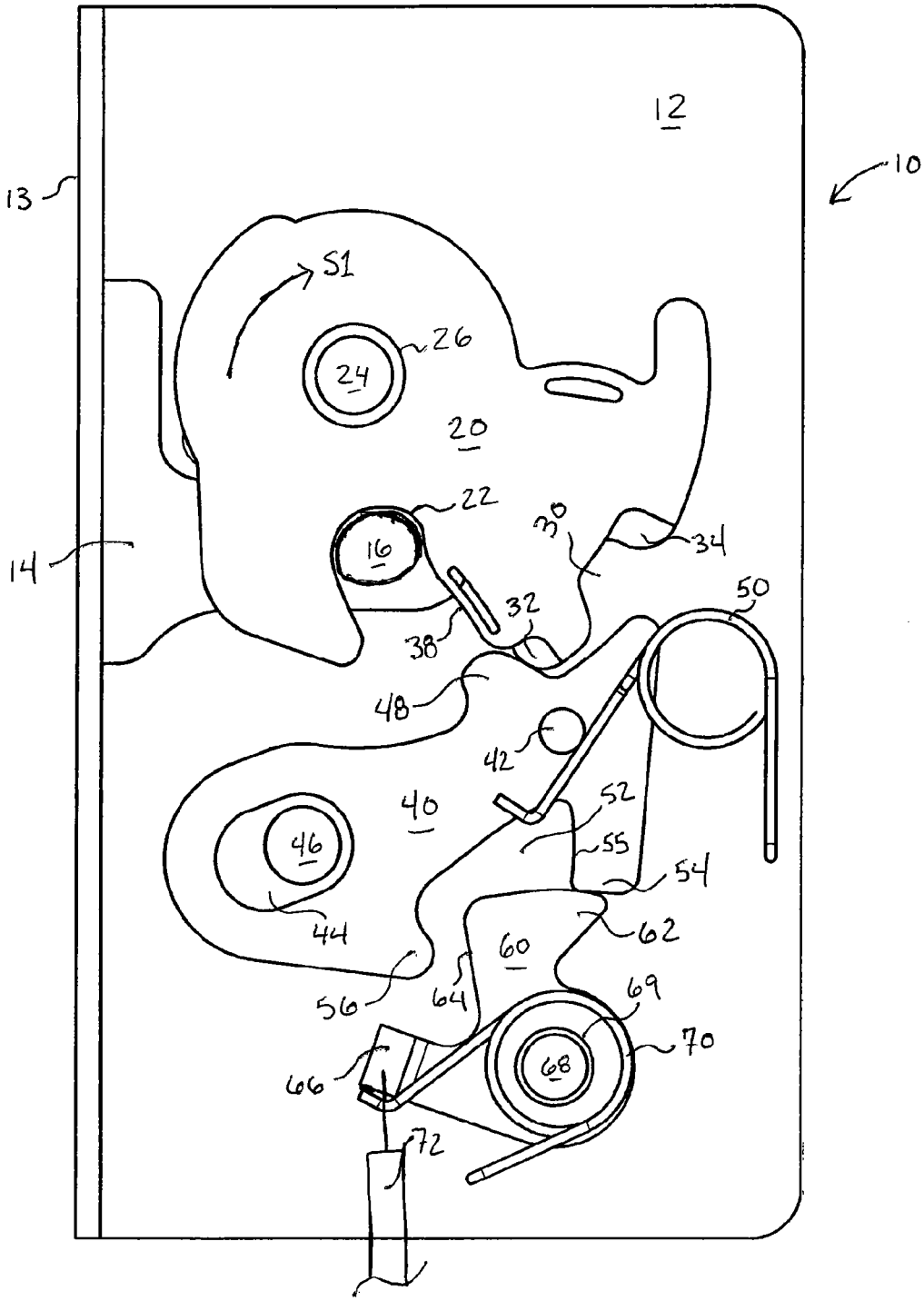
FIG. 1 is a front view of a lock unit in accordance with an embodiment of the present invention in the primary latched position.
Figure 3:
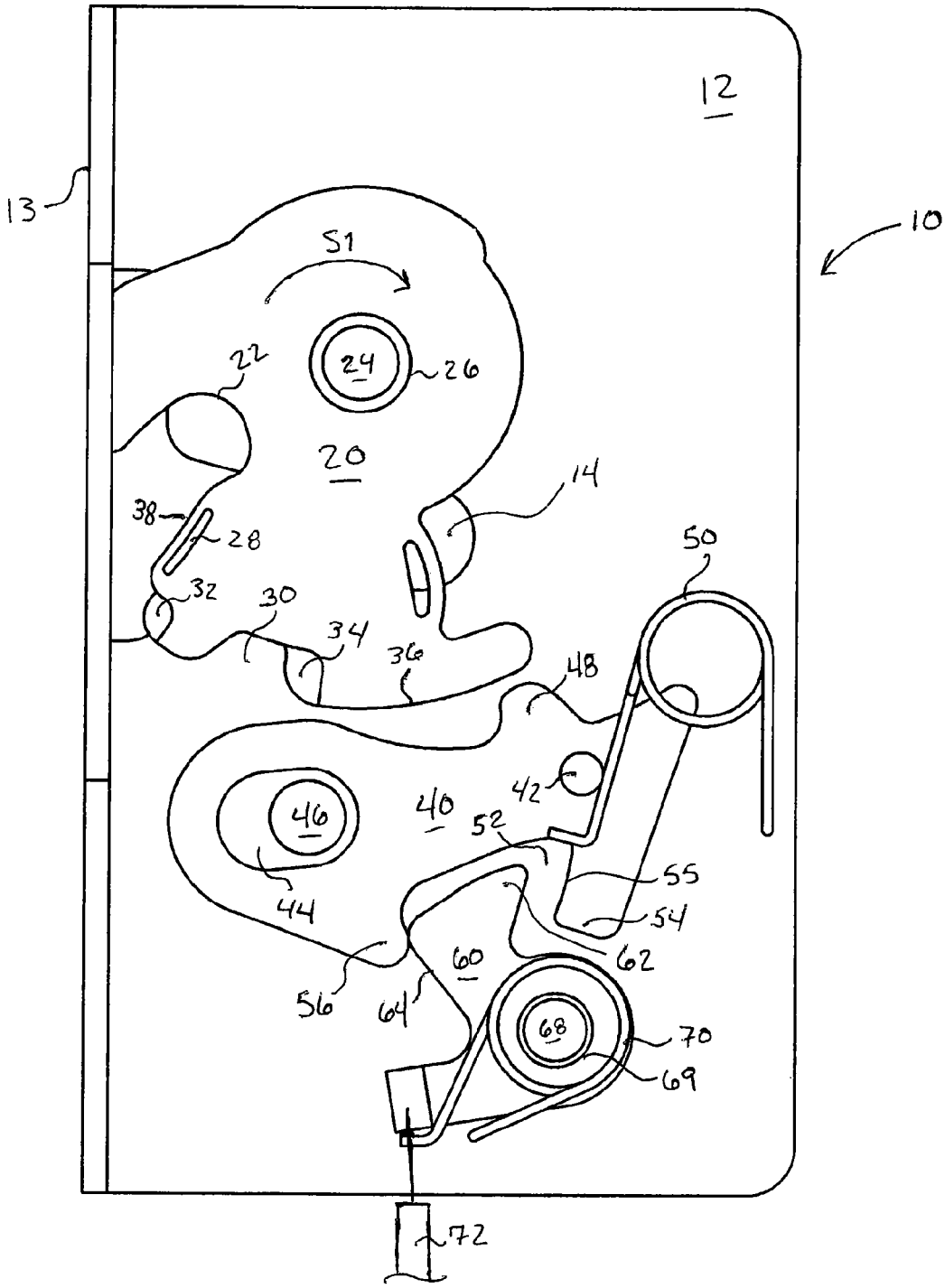
FIG. 3 is a front view of a lock unit in accordance with an embodiment of the present invention in the open position.

Referring to FIGS. 1 and 3, a lock unit 10 according to an embodiment of the present invention is shown in the primary latched position and the open position, respectively. The lock unit 10 includes a baseplate 12 for mounting the lock unit 10 to a door, hatch or tailgate of a vehicle with a slot 14 facing a striker 16 mounted to the vehicle body. Typically, the striker 16, or catch bolt, is a pin or U-shaped bracket mounted to a partition at the rear side of the vehicle doorframe and extending into the plane of the door opening. The lock unit 10 is typically mounted opposite the vehicle door hinges with the leading edge 13 of the baseplate 12 facing the striker 16 and the components of the lock unit 10 being disposed in the vehicle door. With such a configuration, as the vehicle door is shut, the striker 16 extends into the slot 14 of the baseplate 12 and into a first recess 22 of a catch 20 to rotate the catch 20 from an open position (FIG. 3) to a primary latched position (FIG. 1). It is noted where the striker 16 is located on the vehicle door, the lock unit 10 is mounted to the vehicle body and, regardless of its placement, a housing or cover could also be provided in addition to or in lieu of the baseplate 12 to further protect the components of the lock unit 10.

In one embodiment, the catch 20, pawl 40 and ratchet 60 can be relatively flat parts made from metal or plastic. A pawl spring 50 may be connected to the pawl 40 in by securing one end of the spring behind peg 42, which can be added to the pawl 40 by a subsequent operation, but may be integrally formed by a molding process. However, in other embodiments, the pawl spring 50 may be connected to the pawl 40 in other ways, e.g., by rotatably positioning one end of a torsion spring into a hole in the pawl 40. In another, less efficient embodiment the pawl may be biased by individual springs towards the catch 20 and longitudinally towards the pawl axis 46. The baseplate 10, and any housing covering the lock unit 10, can also be formed by plastic injection molding. In another embodiment, the lock unit 10 is constructed from metal or a combination of metal and plastic components.

In FIG. 1, the vehicle door is fully closed and the lock unit 10 is in the primary latched position. The catch 20, which is mounted to a catch rotation axis 24 via catch mounting hole 26, retains the striker 16 in a first recess 22. The catch 20 is biased by a spring to rotate about the catch rotation axis 24 in the opening direction S1, but is retained in the primary latched position by a blocking arm 48 of a pawl 40 which, in turn, is held in place by a blocking lever 62 of a ratchet 60. The ratchet 60 is mounted adjacent the pawl 40 to a ratchet rotation axis 68 via a ratchet mounting hole 69. A primary stop 32, which may be located at the bottom of the first recess 22 or on the periphery of the catch 20 between the first and second recesses 22, 30, contacts the blocking arm 48 of the pawl 40. Because the contact faces of the primary stop 32 and the blocking arm 48 are designed so as to slide smoothly apart (e.g., by incorporating positive angled, sloped surfaces of gradually-reduced incline), the blocking lever 62 is provided abutting a stop 54 of the pawl 40.

Regardless of the relative placement of the blocking lever 62 and stop 54, the ratchet 60 may be prevented from rotating by the normal force from the stop 54 running through the ratchet rotation axis 68. However, it is preferable to limit the rotation of the ratchet 60 about the ratchet rotation axis 68 using a ratchet spring 70, which may be a torsion spring having one end connected to the baseplate 12 and the other end connected to the ratchet 60 at a spring support 66. Thus, even if the force from the stop 54 causes a moment to be applied to the ratchet 60 (i.e., normal force does not run through the ratchet rotation axis 68), the ratchet spring 70 will hinder rotation and maintain contact between the blocking lever 62 and the stop 54, thereby maintaining the position of the pawl 40 and preventing the primary stop 32 from coming free from the blocking arm 48. Limit stops (e.g., protrusions extending from the baseplate 12) could also be used to limit the rotation of the ratchet 60, as well as the catch 20 and the pawl 40, to a predetermined range of motion. According to an embodiment, the rotation of the ratchet 60 is at its limits in the clockwise direction when in the primary latched position and is biased to that position by ratchet spring 70.

Figure 2:
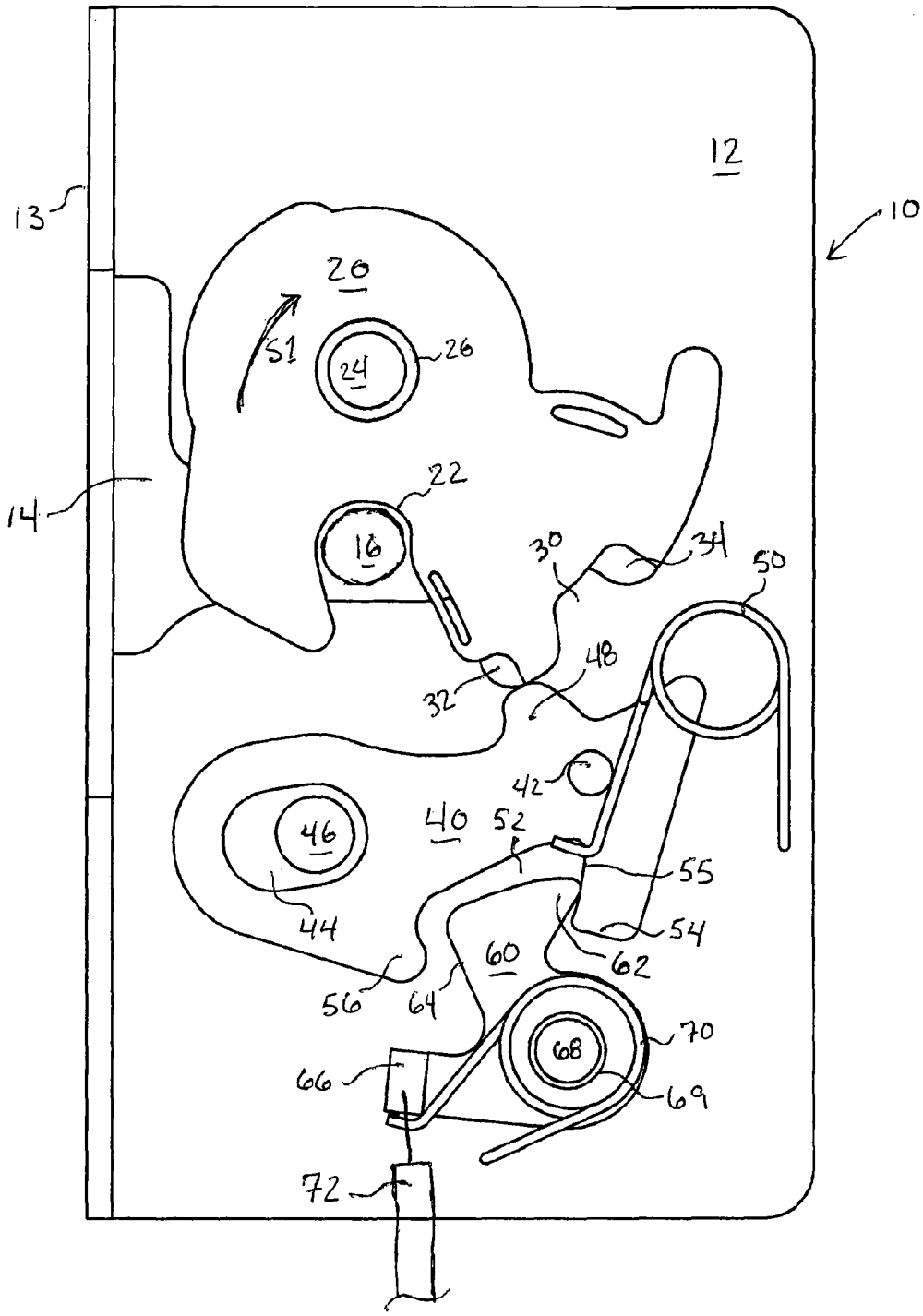
FIG. 2 is a front view of a lock unit in accordance with an embodiment of the present invention with the catch released from the primary latched position.

In order to open the vehicle door, the lock unit 10 is released from the primary latched position shown in FIG. 1 by moving the blocking lever 62 away from the stop 54. Preferably, the ratchet 60 is connected to an operating link 72 at spring support 66, or at another point of the ratchet 60, so as to enable a rotation of the blocking lever 62 counter-clockwise away from the stop 54 as shown in FIG. 2. The operating link 72 is connected outside the lock unit 10 to an inside and/or outside door handle (e.g., designed as a rod assembly or Bowden cable) which is actuated by a user opening the vehicle door. Alternatively, the rotation of the ratchet 60 could be controlled by a servo motor and operated by a switch or sensor.

Referring to FIG. 2, the lock unit 10 is shown immediately after release of the catch 20 from the primary latched position. It is noted that the release is rather quick since only one lever needs to be actuated to release the catch 20. Once the blocking lever 62 clears the stop 54, the spring force of the catch 20 causes it to rotate and the primary stop 32 slides smoothly along the blocking arm 48, thereby causing the pawl 40 to rotate in a clockwise direction toward the ratchet 60. At this point, the blocking lever 62 is accommodated in a recessed portion 52 of the pawl 40 adjacent the stop 54.

Once the primary stop 32 clears the blocking arm 48 at the position shown in FIG. 2, the catch 20 is free to rotate in the opening direction S1. Due to the speed of rotation of the catch 20 and the transitional curved surfaces of the blocking arm 48 and the secondary stop 34, the lock unit 10 skips over the secondary latched position shown in FIG. 5 as the second recess 30 and secondary stop 34 of the catch 20 slide past the blocking arm 48. The catch 20 continues to rotate until it is stopped by the baseplate 12 through slot 14, full extension of the spring or by a different limit stop as shown in the open position of FIG. 3. While the catch 20 rotates, its spring force in the opening direction S1 pushes the striker 16 through the slot 14 toward the leading edge 13 of the base plate 12, thereby separating the vehicle door from the body. In this manner, the lock unit 10 is self-opening since it does not require external actuation forces after release.

Referring to FIG. 3, the ratchet 60 can continue to rotate in a counter-clockwise direction during and/or after the full-travel of the catch 20 by the continuing actuation of the operating link 72 such that a release edge 64 presses, against a release arm 56 of the pawl 40 to rotate it away, clear from the catch 20. This position could be maintained by locking the ratchet 60 in position until the vehicle door is closed. However, preferably, the open position of the lock unit 10 is achieved once ratchet 60 is released to abut blocking lever 62 against the lever retaining wall 55 of the recessed portion 52 and the pawl spring 50 rotates the pawl 40 back toward the catch 20 such that the blocking, arm 48 abuts the sliding surface 36 of the catch 20.

Figure 4:
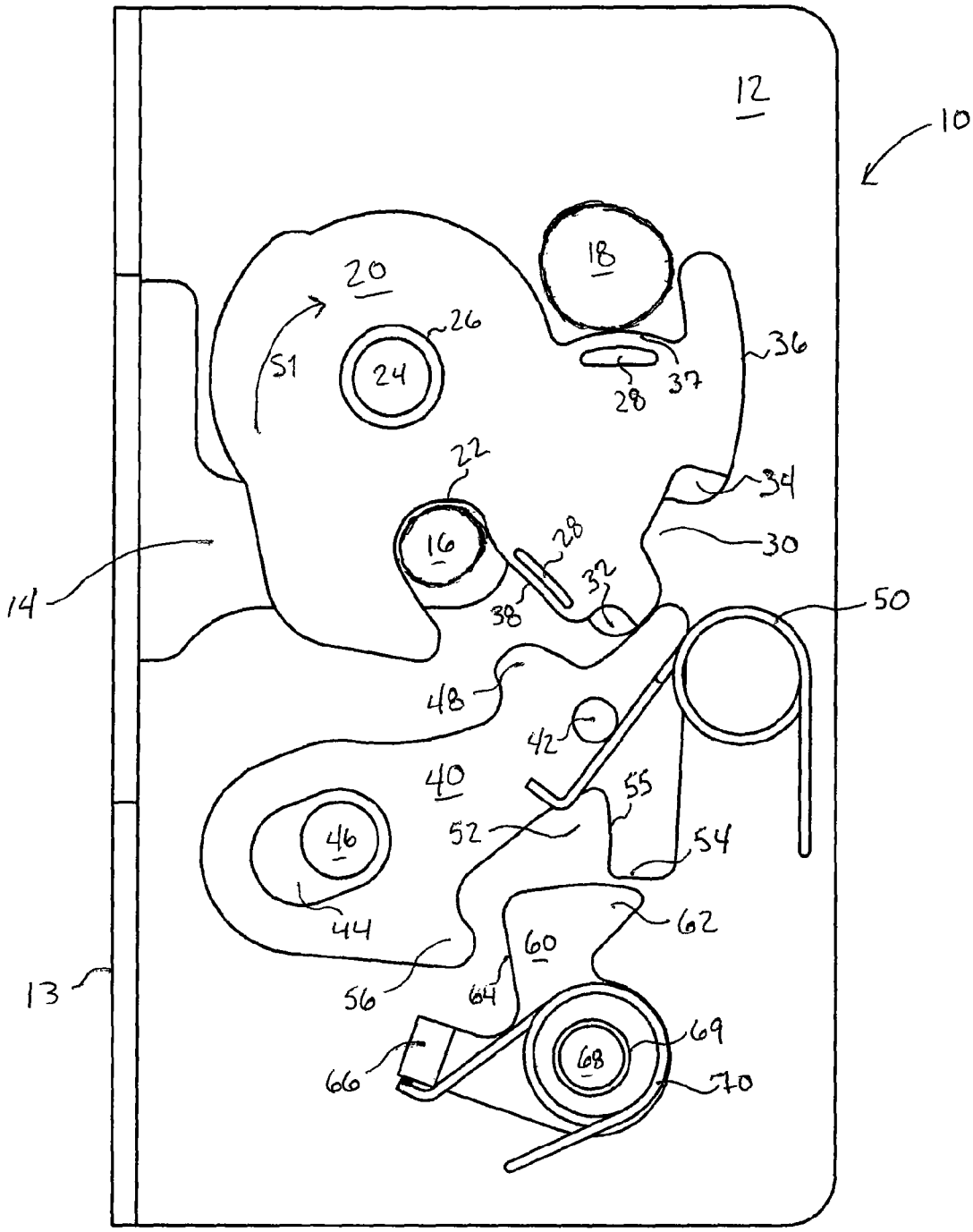
FIG. 4 is a front view of a lock unit in accordance with an embodiment of the present invention in the catch over-travel position.
Figure 5:
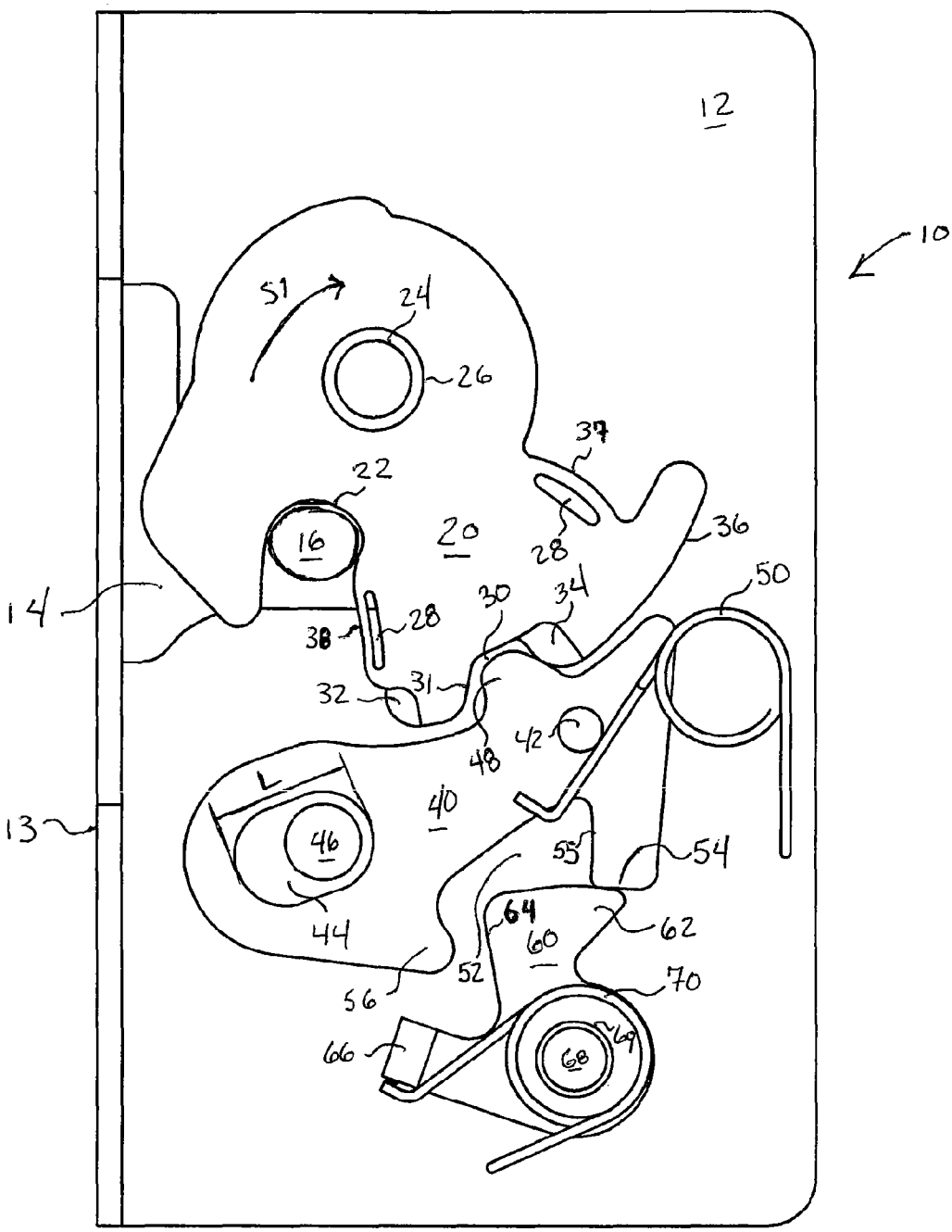
FIG. 5 is a front view of a lock unit in accordance with an embodiment of the present invention in the secondary latched position.

When a user closes the vehicle door, the striker 16 enters into the slot 14 and hits against a striking edge 38 of the first recess 22. The force of the door as it closes causes the striker 16 to press against the striking edge 38 of the first recess 22, thereby rotating the catch 20 against the spring force opposite the opening direction S1. During initial rotation, the blocking arm 48 of the pawl 40 slides along the sliding surface 36 of the catch 20. Similarly to the release of the catch 20 when opening the door, the second recess 30 and the primary stop 32 will slide past the blocking arm 48 such that the secondary latched position shown in FIG. 5 is bypassed as long as the door is shut with sufficient force. In such a case, the catch 20 may reach an over-travel position shown in FIG. 4. After the primary stop 32 of the catch 20 clears the blocking arm 48 of the pawl 40, the pawl spring 50 rotates the pawl 40 sufficiently away from the ratchet 60 such that the blocking lever 62 travels with its tip along the lever retaining wall 55 until it exits the recessed portion 52, at which point, the ratchet spring 70 rotates the blocking lever 62 back to its position below the stop 54. In one embodiment, the blocking lever 62 has a rounded tip to facilitate a smooth sliding along the lever retaining wall 55, which may also be canted and preferably extends from stop 54 towards the catch 20.

However, in a case where the vehicle door is not shut with sufficient force (i.e., closed too slowly), the lock unit 10 enters into the secondary latched position shown in FIG. 5. The secondary latched position falls between the primary latched position and the open position such that if the primary latched position is not engaged, the lock unit 10 will not disengage to the open position which would release the vehicle door during travel and place the vehicle occupants at considerable risk. Latching mechanisms can release from the primary latched position due to the outward force applied by the vehicle door compression seals, vehicle vibrations and impacts to the vehicle and the like; when this occurs, the latching mechanism must have a secondary latched position to prevent the door from opening.

Referring to FIG. 5, the secondary latched position according to an embodiment of the present invention is shown. When a user shuts the vehicle door too slowly, the second recess 30 of the catch 20 does not slide past the blocking arm 48 of the pawl 40; rather, after sliding surface 36 slides past the blocking arm 48, the blocking arm 48 is pressed into the second recess 30 of the catch 20, thereby assuming the secondary latched position. In response to the continued closing of the vehicle door, or an additional external force which may be applied by the user or a servo motor, the catch 20 continues to rotate opposite the opening direction S1. When this happens, the exit edge 31 of the second recess 30 presses against the blocking arm 48 in the direction of the slot 44. The pawl spring 50 abuts peg 42 disposed on the pawl 40, or is otherwise connected to the pawl 40, such that it biases the pawl 40 toward both the catch 20 and the pawl pivot axis 46. The force translated to the pawl 40 by the exit edge 31 pressing against the blocking arm 48 is at least partially, and preferably substantially, in a longitudinal direction L of the slot 44.

Figure 6:
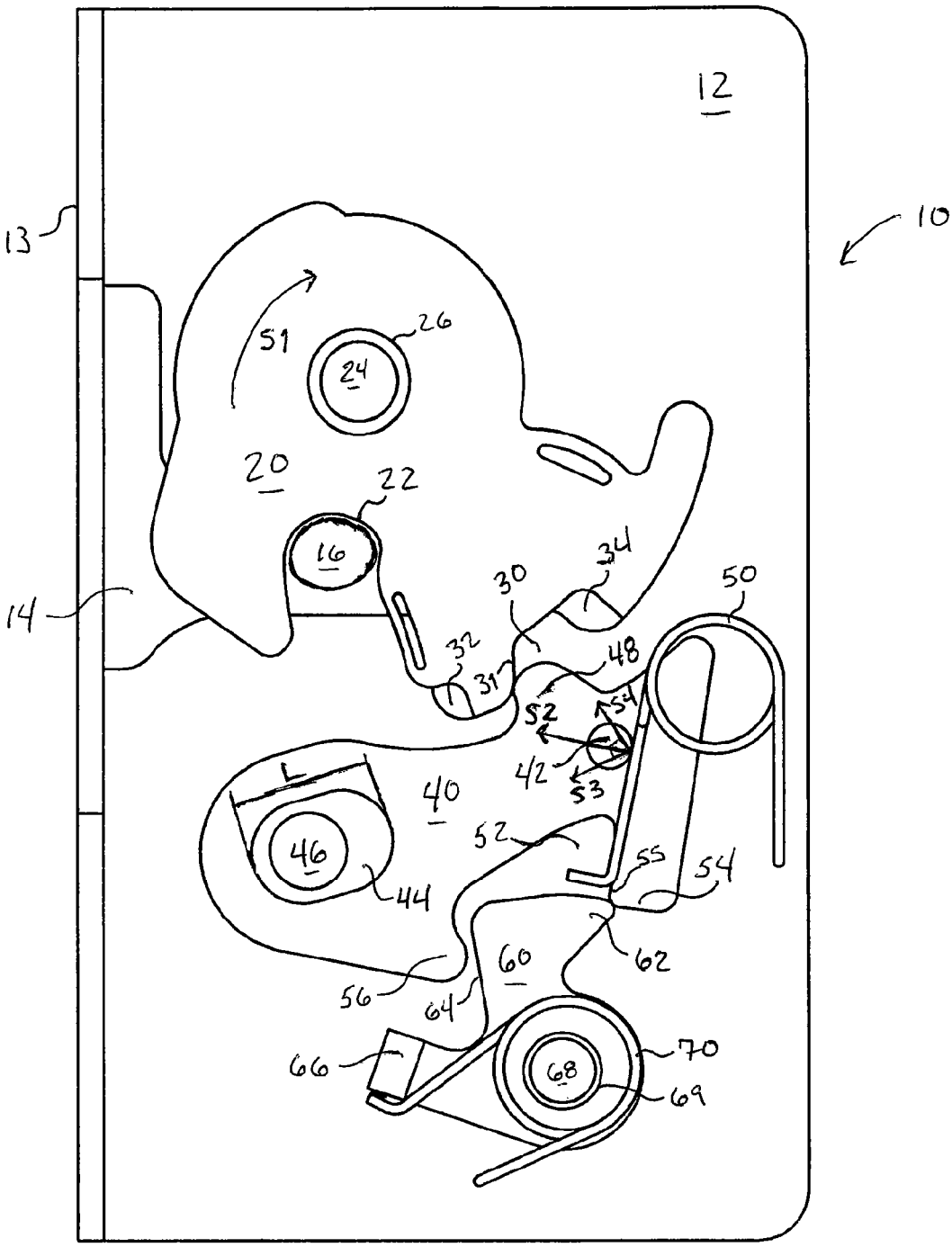
FIG. 6 is a front view of a lock unit in accordance with an embodiment of the present invention after linear travel of the pawl from the secondary latched position.

Referring to FIG. 6, the lock unit 10 is shown traveling from the secondary latched position toward the primary latched position after linear travel of the pawl 40 in the longitudinal direction L of the slot 44. The pawl spring 50 biases the pawl 40 in the direction of spring force S2 toward the catch 20 and the fixed pawl pivot axis 46. For better understanding of the forces, spring force S2 is shown as a resultant vector of two component forces, a first force component S3 acting along the longitudinal direction L of the slot 44 and a second force component S4 acting in the direction of the catch 20. The force applied to the pawl 40 by the catch 20 as it rotates opposite the opening direction S1 is generally in the longitudinal direction L of the slot 44 due to the relative locations of the contact faces of the exit edge 31 and the blocking arm 48. The exit edge 31 is gradually curved to achieve a smooth sliding against the curved edge of the blocking arm 48. Preferably, the contact face of the blocking arm 48 is shorter and has a steeper curve while the contact face of the exit edge 31 is longer and more linear to ensure a sufficient and consistent force in the longitudinal direction L of the slot 44 while exit edge 31 and blocking arm 48 slide against one. However, many different complementary surfaces can be used on the exit edge 31 and blocking arm 48, such as flat and rounded, chamfered and canted, etc.

The pawl 40 is biased toward the pawl pivot axis 46 in the longitudinal direction L of the slot 44 by first force component S3 and biased toward the catch 20 by the second force component S4, together spring force S2. The force applied to the pawl 40 as the exit edge 31 slides against the blocking arm 48 counter-acts the first force component S3 to compress the pawl spring 50 and move the pawl 40 linearly along the longitudinal direction L of the slot 44 while the second force component S4 holds the pawl 40 against the catch 20. Once the pawl linear travel exceeds the stationary tip of the blocking lever 62, the pawl is free to rotate clockwise away from catch 20. At the point shown in FIG. 6, the pawl pivot axis 46 is located near the opposite end of the slot 44 and the stop 54 has essentially cleared the tip of the blocking lever 62 due to the linear travel of the pawl 40. At this point, the downward rotation of the pawl 40 as the blocking arm 48 slides to the transition region between the exit edge 31 and primary stop 32 allows the blocking lever 67 to move into the recessed portion 52 along the lever retaining wall 55.

Figure 7:
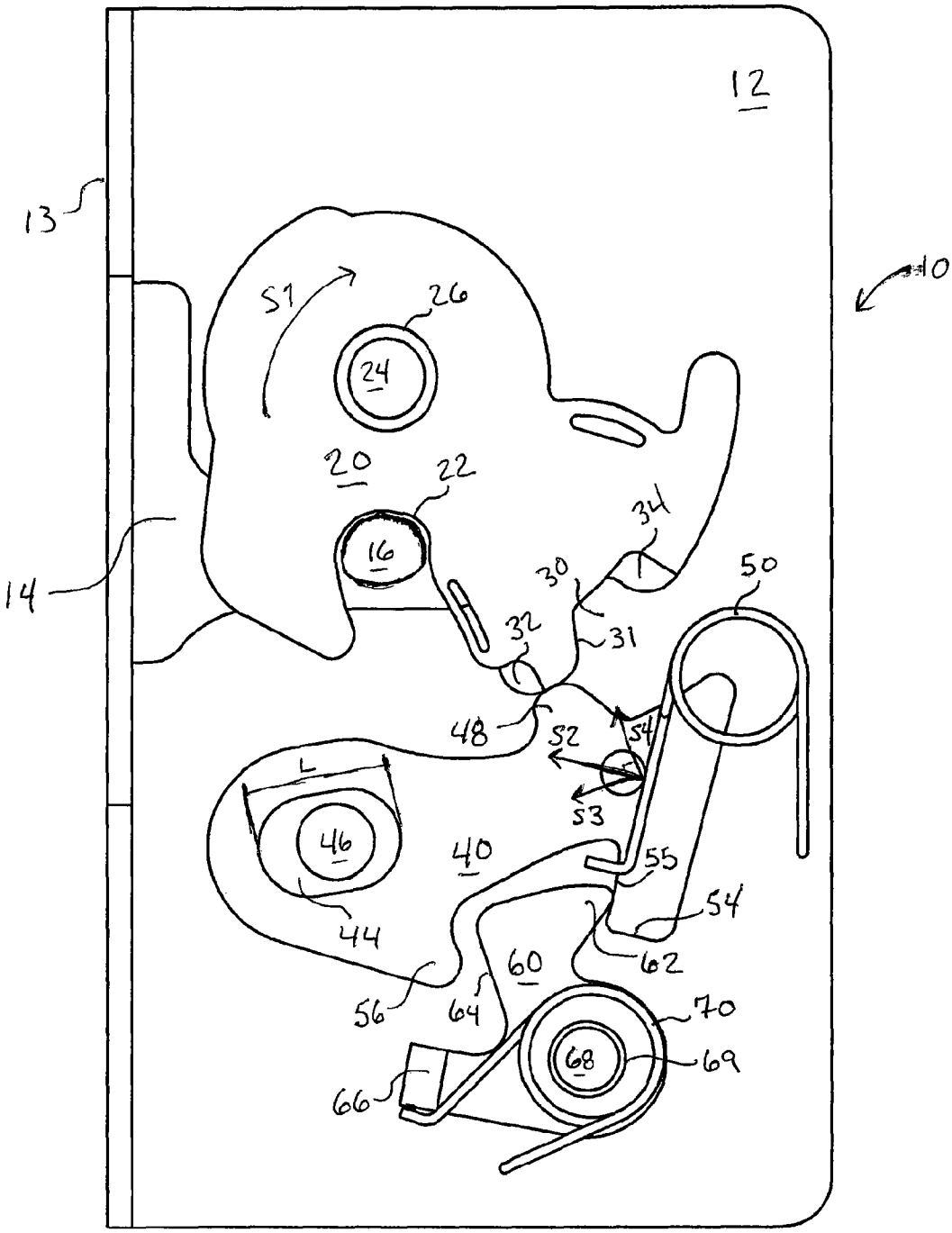
FIG. 7 is a front view of a lock unit in accordance with an embodiment of the present invention during reset of the linear position of the pawl.

Referring to FIG. 7, the lock unit 10 is moving back to the primary latched position as the catch 20 is released from the blocking arm 48 of the pawl 40. Thus, while the catch 20 continues to rotate opposite the opening direction S1, the pawl 40 is moving in the opposite direction of the catch 20. Since the pawl 40 is also moving toward the primary latched position, the speed of rotation of the catch 20 can be slow or even stopped depending on the range of movement of pawl 40 along the longitudinal direction L of the slot 44.

As the primary stop 32 of catch 20 nears the primary latched position, the blocking arm 48 of pawl 40 slides smoothly up along primary stop 32. The linear reset of pawl 20 relative to the pawl pivot axis may or may not take place with a rotation of the ratchet 60. The positive slope between the blocking arm 48 and primary stop 32 are sufficient to allow pawl 40 to rotate into the catch 20 and clear blocking lever 62 with only slight over-travel rotation of catch 20. If the first force component S3 is sufficient to overcome ratchet spring 70 and the speed slow enough to overcome the stationary inertia of ratchet 60, the linear reset of pawl 20 may take place through rotation of the ratchet 60 prior to the catch 20 reaching the primary latched position. After reaching the position of the lock unit 10 shown in FIG. 7, the primary stop 32 begins to slide smoothly down along the blocking arm 48 and the tip of the blocking lever 62 slides smoothly down along the lever retaining wall 55 until it is released to rest below the stop 54 to return the lock unit 10 to the primary latched position (cf. FIGS. 7 and 1).

While the invention has been particularly shown and described with reference to preferred embodiments thereof, it will be understood by those skilled in the art that various changes in form and details may be made therein without departing from the spirit and scope of the invention.

What is claimed is:

1. A lock unit for a vehicle comprising:

a rotatable catch biased in an opening direction about a catch rotation axis toward an open position of the lock unit in which a first recess of the catch is configured to receive a striker of the vehicle, the catch including a second recess disposed before the first recess in the opening direction;

a pawl having a slot that is linearly elongated in a longitudinal direction, the pawl being rotatable about a fixed pawl pivot axis disposed in the slot, the pawl being biased toward the catch and including a blocking arm extending into the second recess of the catch while the lock unit is in a secondary latched position; and a ratchet having a blocking lever that abuts a stop of the pawl to maintain engagement of the pawl against the catch in a primary latched position of the lock unit, wherein the pawl moves linearly in the longitudinal direction of the slot as the lock unit is moved from the secondary latched position to the primary latched position opposite the opening direction of the catch.

2. The lock unit according to claim 1, wherein the pawl is disposed between the ratchet and the catch.

3. The lock unit according to claim 1, wherein the blocking arm abuts a primary stop of the catch when the lock unit is in the primary latched position.

4. The lock unit according to claim 2, wherein the blocking lever is at least partially disposed in a recessed portion of the pawl when the lock unit is in the secondary latched position and the open position.

5. The lock unit according to claim 3, wherein the ratchet includes a release edge and is rotatable at least from the stop of the pawl to a position past a release arm of the pawl to release the lock unit from the primary latched position toward the open position.

6. The lock unit according to claim 3, wherein the primary stop and the blocking arm have complementarily curved contact faces.

7. The lock unit according to claim 3, wherein the second recess includes an exit edge and a secondary stop on opposite sides thereof.

8. The lock unit according to claim 7, wherein the exit edge is curved toward a transition region between the exit edge and the primary stop and the secondary stop is curved toward a sliding surface of the catch.

9. The lock unit according to claim 8, wherein the exit edge presses against the blocking arm of the pawl to move the pawl in the longitudinal direction of the slot when the lock unit is moved from the secondary latched position to the primary latched position.

10. The lock unit according to claim 3, wherein the ratchet is biased toward the stop of the pawl and is connected to an operating link of the vehicle so as to be rotatable away from the stop to release the lock unit from the primary latched position.

11. A lock unit for a vehicle comprising:

a catch rotatable at least from a primary latched position to an open position;

a pawl having a slot that is linearly elongated in a longitudinal direction, the pawl being rotatable about a fixed pawl pivot axis disposed in the slot, and movable linearly against a spring force in the longitudinal direction of the slot from a secondary latched position, intermediate the open position and the primary latched position, to the primary latched position; and a ratchet having a blocking lever that abuts a stop of the pawl to maintain engagement of the pawl against the catch in the primary latched position of the lock unit.

12. The lock unit according to claim 11, wherein the pawl is disposed between the ratchet and the catch.

13. The lock unit according to claim 11, wherein the blocking arm abuts a primary stop of the catch when the lock unit is in the primary latched position.

14. The lock unit according to claim 12, wherein the blocking lever is at least partially disposed in a recessed portion of the pawl when the lock unit is in the secondary latched position and the open position.

15. The lock unit according to claim 13, wherein the ratchet includes a release edge and is rotatable at least from the stop of the pawl to a position past a release arm of the pawl to release the lock unit from the primary latched position toward the open position.

16. The lock unit according to claim 13, wherein the primary stop and the blocking arm have complementarily curved contact faces.

17. The lock unit according to claim 13, wherein the catch includes a second recess adapted to at least partially retain the blocking arm of the pawl when the lock unit is in the secondary latched position, the second recess including an exit edge and a secondary stop on opposite sides thereof.

18. The lock unit according to claim 17, wherein the exit edge is curved toward a transition region between the exit edge and the primary stop and the secondary stop is curved toward a sliding surface of the catch.

19. The lock unit according to claim 18, wherein the exit edge presses against the blocking arm of the pawl to move the pawl in the longitudinal direction of the slot when the lock unit is moved from the secondary latched position to the primary latched position.

20. The lock unit according to claim 13, wherein the ratchet is biased toward the stop of the pawl and is connected to an operating link of the vehicle so as to be rotatable away from the stop to release the lock unit from the primary latched position.

* * * * *